US010605534B2

(12) United States Patent
Persson

(10) Patent No.: US 10,605,534 B2
(45) Date of Patent: Mar. 31, 2020

(54) PLATE HEAT EXCHANGER

(71) Applicant: Danfoss Micro Channel Heat Exchanger (Jiaxing) Co., Ltd., Zhejiang (CN)

(72) Inventor: Lars Persson, Zhejiang (CN)

(73) Assignee: Danfoss Micro Channel Heat Exchanger (Jiaxing) Co., Ltd., Haiyan, Zhejiang (CN)

( * ) Notice: Subject to any disclaimer, the term of this patent is extended or adjusted under 35 U.S.C. 154(b) by 211 days.

(21) Appl. No.: 14/648,979

(22) PCT Filed: Dec. 4, 2013

(86) PCT No.: PCT/CN2013/088503

§ 371 (c)(1),
(2) Date: Jun. 2, 2015

(87) PCT Pub. No.: WO2014/090102

PCT Pub. Date: Jun. 19, 2014

(65) Prior Publication Data

US 2015/0300743 A1 Oct. 22, 2015

(30) Foreign Application Priority Data

Dec. 10, 2012 (CN) ..... 2012 1 0535175

(51) Int. Cl.
*F28D 7/00* (2006.01)
*F28D 9/00* (2006.01)
(Continued)

(52) U.S. Cl.
CPC ..... *F28D 7/0066* (2013.01); *F28D 9/005* (2013.01); *F28D 9/0037* (2013.01);
(Continued)

(58) Field of Classification Search
CPC ..... F28F 3/005; F28F 3/02; F28F 3/08; F28F 3/083; F28F 9/001; F28F 9/026;
(Continued)

(56) References Cited

U.S. PATENT DOCUMENTS 1,508,860 A * 9/1924 Stuart ..... F28F 3/086 165/179
5,203,406 A * 4/1993 Blomgren ..... C01D 3/06 159/28.6

(Continued)

FOREIGN PATENT DOCUMENTS

CN 102980328 A 3/2013
DE 10 2007 002 340 B3 6/2008

(Continued)

OTHER PUBLICATIONS

European Search Report for European Application No. EP13861620.6 dated Sep. 23, 2016.

(Continued)

*Primary Examiner* — Larry L Furdge
*Assistant Examiner* — Nael N Babaa
(74) *Attorney, Agent, or Firm* — McCormick, Paulding & Huber PLLC

(57) ABSTRACT

The prevent invention provides a plate heat exchanger. The plate heat exchanger comprises heat exchange plates each forms one or more first fluid channels and one or more second fluid channels. The one or more first fluid channels each has a fluid channel upstream portion and a fluid channel downstream portion separated from the fluid channel upstream portion, wherein the fluid channel upstream portion is fluidly communicated via a fluid communication device with the fluid channel downstream portion. The plate heat exchanger according to the present invention achieves uniform distribution of the refrigerant while being indepen- (Continued)

dent of the distributors, and, provides different heat exchange regions in the channels on the basis of heat-transfer mechanism correlated to refrigerant evaporation, to reinforce the heat transfer. The plate heat exchanger, without the distributors, according to the present invention not only reduces difficulties on productions and processes, but also, widens practical application scopes and conditions. In addition, as there is no distributor in the plate heat exchanger, compared with other similar products, the refrigerant stream has a lower total pressure drop, which brings more spaces for type selection of the expansion valve.

19 Claims, 6 Drawing Sheets

(51) Int. Cl.

| | |
|---|---|
| ***F28F 13/06*** | (2006.01) |
| ***F28F 9/02*** | (2006.01) |
| ***F28F 9/22*** | (2006.01) |
| ***F28F 3/02*** | (2006.01) |
| ***F28F 9/00*** | (2006.01) |
| ***F28F 3/08*** | (2006.01) |
| *F25C 1/12* | (2006.01) |

(52) U.S. Cl.
CPC ..... *F28D 9/0093* (2013.01); *F28F 3/02* (2013.01); *F28F 3/08* (2013.01); *F28F 3/086* (2013.01); *F28F 9/001* (2013.01); *F28F 9/026* (2013.01); *F28F 9/22* (2013.01); *F28F 13/06* (2013.01); *F25C 1/12* (2013.01); *F28D 9/0043* (2013.01); *F28D 9/0056* (2013.01)

(58) Field of Classification Search
CPC ..... F28D 9/0037; F28D 9/0043; F28D 9/005; F28D 9/0056; F28D 9/0093
See application file for complete search history.

(56) References Cited

U.S. PATENT DOCUMENTS

| | | | | |
|---|---|---|---|---|
| 5,909,767 | A | 6/1999 | Batt | |
| 5,950,715 | A * | 9/1999 | Jonsson | F28D 9/005 165/103 |
| 2005/0056411 | A1 * | 3/2005 | Dilley | F28D 9/0018 165/167 |
| 2012/0325446 | A1 * | 12/2012 | Wakamatsu | F28F 3/044 165/167 |

FOREIGN PATENT DOCUMENTS

| | | | |
|---|---|---|---|
| JP | 2547600 | Y2 | 5/1997 |
| JP | 10300371 | A | 11/1998 |
| JP | 2006-226628 | A | 8/2006 |
| WO | 97/08506 | A1 | 3/1997 |
| WO | 2009/123516 | A1 | 10/2009 |

OTHER PUBLICATIONS

International Search Report for PCT Serial No. PCT/CN2013/088503 dated Feb. 10, 2014.
Korean Office Action and English Translation for Serial No. 10-2015-7018000 dated Oct. 31, 2019.

* cited by examiner

PLATE HEAT EXCHANGER

CROSS-REFERENCE TO RELATED APPLICATION

This application is entitled to the benefit of and incorporates by reference subject matter disclosed in the International Patent Application No. PCT/CN2013/088503 filed on Dec. 4, 2013 and Chinese Patent Application 201210535175.3 filed Dec. 10, 2012.

BACKGROUND OF THE INVENTION

Field of the Invention

The present invention relates to a plate heat exchanger.

Description of the Related Art

For a paralleled-channel heat exchanger (evaporator), especially, for a plate heat exchanger and a micro channel heat exchanger, mal-distribution of the refrigerant is a worldwide technical problem. Generally, the refrigerant entered into the heat exchanger is in a two-phase manner, since complicated application conditions and two-phase flows, it is hard to achieve uniform distribution of the refrigerant. In most cases, excess liquid refrigerant will flow into some of the channels while excess gaseous refrigerant will flow into some other of the channels, which may greatly impact integral performance of the evaporator.

The prior art solution for refrigerant distribution is achieved based on a distributor technology. There are common measures liking guide duct, guide ring, embedded distributor, etc. The main concept of the prior art solution is to dispose an inlet of each channel of the heat exchanger to have a small circulation cross section, such as a small hole and small slit, to control mass flow rate of the refrigerant into the channel, so as to uniform overall refrigerant distribution. Since aperture size of the distributor is generally about 0.5-2.0 mm, the technology faces great challenges in design and manufacturing.

SUMMARY

The present invention has been made to overcome or alleviate at least one aspect of the above mentioned disadvantages existing in the conventional technical solutions.

Accordingly, it is an object of the present invention to provide a plate heat exchanger, which, for example, may achieve uniform distribution of the refrigerant while being independent of the distributors.

According to one aspect of the present invention, there is provided a plate heat exchanger comprising:

heat exchange plates each forms one or more first fluid channels and one or more second fluid channels, wherein a first fluid flows in the one or more first fluid channels, while a second fluid flows in the one or more second fluid channels, and wherein the one or more first fluid channels each has a fluid channel upstream portion and a fluid channel downstream portion separated from the fluid channel upstream portion, wherein the fluid channel upstream portion is fluidly communicated via a fluid communication device with the fluid channel downstream portion.

According to one aspect of the present invention, the plate heat exchanger further comprises an outlet of the fluid channel upstream portion and an inlet of the fluid channel downstream portion, the outlet of the fluid channel upstream portion is fluidly communicated via the fluid communication device with the inlet of the fluid channel downstream portion.

According to one aspect of the present invention, the plate heat exchanger further comprises a divider which separates the fluid channel upstream portion from the fluid channel downstream portion.

According to one aspect of the present invention, the plate heat exchanger further comprises an outlet of the fluid channel upstream portion and an inlet of the fluid channel downstream portion, the outlet of the fluid channel upstream portion and the inlet of the fluid channel downstream portion are adjacent to the divider.

According to one aspect of the present invention, the fluid communication device comprises a channel or a chamber.

According to one aspect of the present invention, the plate heat exchanger further comprises: an end plate provided on an outer side of the heat exchange plate and having a recess which, together with a corresponding portion of the outer side of the heat exchange plate, forms a chamber as the fluid communication device; the outlet of the fluid channel upstream portion and the inlet of the fluid channel downstream portion are fluidly communicated with the chamber.

According to one aspect of the present invention, the plate heat exchanger further comprises: an end plate provided on an outer side of the heat exchange plate; and a chamber plate disposed on the outer side of the end plate and having a recess which, together with a corresponding portion of the outer side of the end plate, forms a chamber as the fluid communication device; the outlet of the fluid channel upstream portion and the inlet of the fluid channel downstream portion are fluidly communicated with the chamber.

According to one aspect of the present invention, the recess is adjacent to a separation between the fluid channel upstream portion and the fluid channel downstream portion.

According to one aspect of the present invention, the heat exchange plate is an integral heat exchange plate.

According to one aspect of the present invention, a distance between the divider and the inlet of the first fluid channels is about 50-80% of the length of the heat exchange plate.

According to one aspect of the present invention, the divider is at least one of line-shaped brazed or soldered joint and metal plate.

According to one aspect of the present invention, the fluid communication device comprises a fluid mixing chamber.

According to one aspect of the present invention, the one or more first fluid channels and the one or more second fluid channels are alternately disposed in a laminated direction of the heat exchange plates.

According to one aspect of the present invention, flow resistance of the fluid channel upstream portion is greater than that of the fluid channel downstream portion, or, flow resistance per unit length of the fluid channel upstream portion is greater than that of the fluid channel downstream portion.

According to one aspect of the present invention, the outlet of the fluid channel upstream portion constitutes an upstream port chamber, the inlet of the fluid channel downstream portion constitutes a downstream port chamber, and, the upstream port chamber and the downstream port chamber are directly communicated or connected with the fluid communication device.

The plate heat exchanger according to the embodiment of the present invention achieves distribution of the refrigerant while being independent of the distributors, and, optimizes effectively distribution of the refrigerant and heat transfer operation on the heat exchange plate, by means of corresponding reinforced heat transfer measures.

As apparent from the above, the plate heat exchanger according to the embodiment of the present invention at least has following advantages:

1. uniform distribution of the refrigerant being independent of the distributors;

2. provision of different heat exchange regions in the channels on the basis of heat-transfer mechanism correlated to refrigerant evaporation, to reinforce the heat transfer;

3. reduction of difficulties on productions and manufacturing and widening of practical application scopes and conditions, by means of the heat exchanger without the distributors;

4. more spaces for type selection of the expansion valve, as there is no distributor in the plate heat exchanger, and compared with other similar products, the refrigerant flow path has a lower total pressure drop; and 5. realization of reinforcing the heat transfer during the condensation process of the refrigerant, for the cases where the evaporator works as the condenser (in a reverse operation of the system).

BRIEF DESCRIPTION OF THE DRAWINGS

These and/or other aspects and advantages of the invention will become apparent and more readily appreciated from the following description of the embodiments, taken in conjunction with the accompanying drawings of which.

Figure 1:
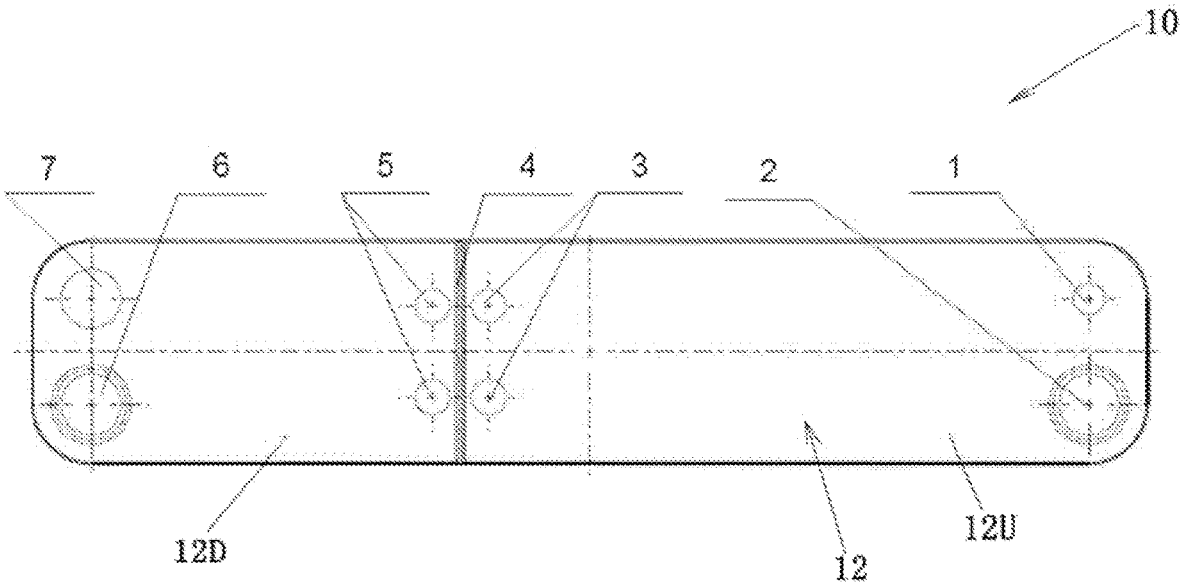
FIG. 1 is a schematic view of a plate heat exchanger according to a first embodiment of the present invention.

The scope of the present invention will in no way be limited to the simply schematic views of the drawings, the number of constituting components, the materials thereof, the shapes thereof, the relative arrangement thereof, etc., are disclosed simply as an example of an embodiment.

DETAILED DESCRIPTION

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

It will be appreciated that the orientation in the drawings does not denote practical use orientation for the plate heat exchanger. And, the drawings are only for demonstration purposes.

1st Embodiment

Referring to FIGS. 1-8, the plate heat exchanger 100 according to the embodiment of the present invention comprises heat exchange plates 10 each forms one or more first fluid channels 12 and one or more second fluid channels and end plates 11 and 13. The ends plates 11 and 13 are provided on the outer side of the plate heat plate 10.

Figure 2:
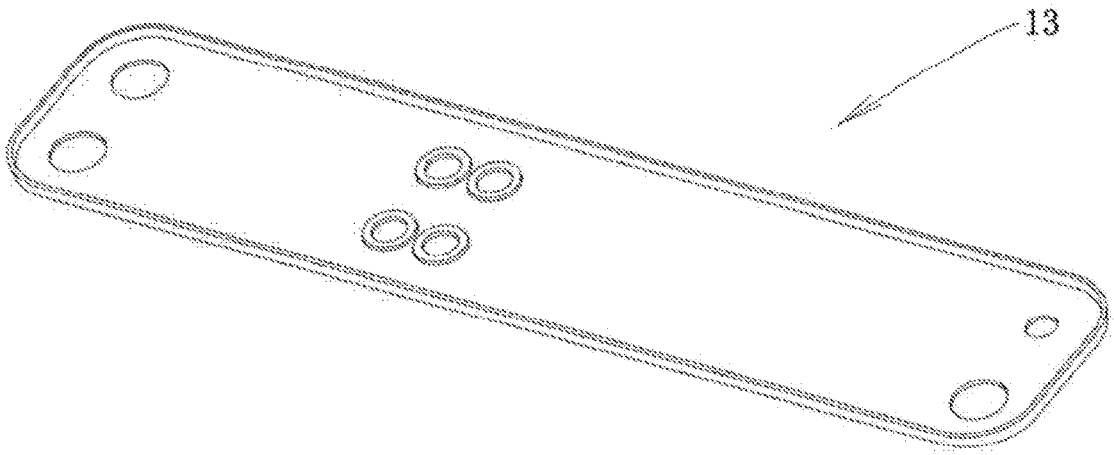
FIG. 2 is a schematic view of an end plate of the plate heat exchanger according to the first embodiment of the present invention.
Figure 3:
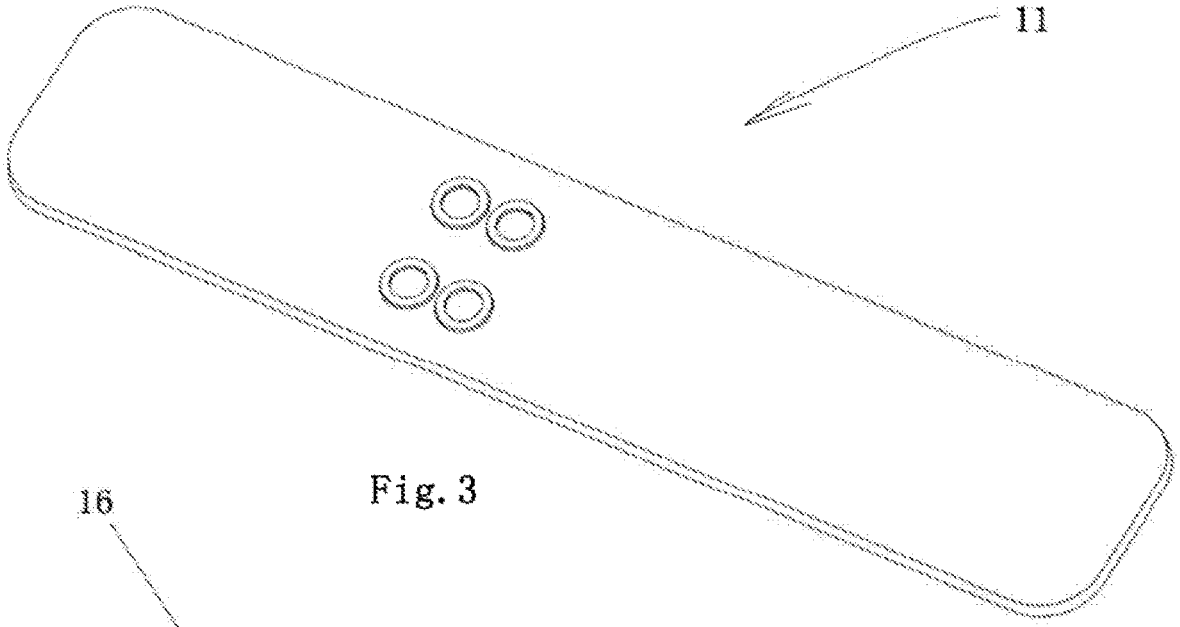
FIG. 3 is a schematic view of another end plate of the plate heat exchanger according to the first embodiment of the present invention.
Figure 4A:
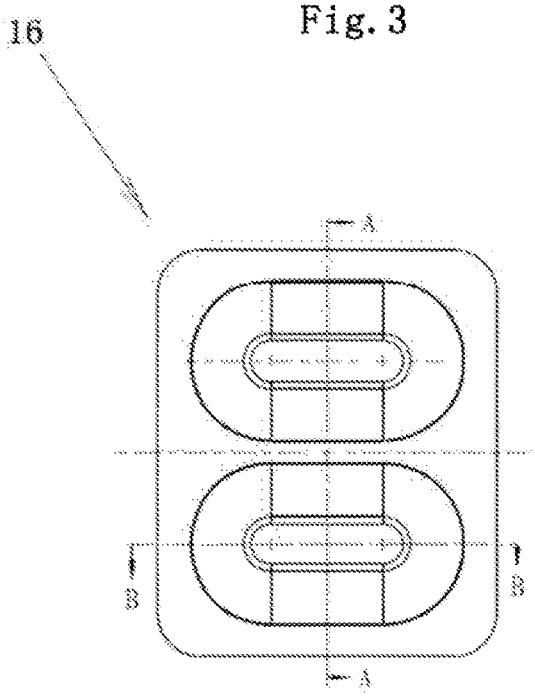
FIG. 4*a* is a schematically front view of a chamber plate of the plate heat exchanger according to the first embodiment of the present invention.
Figure 4B:
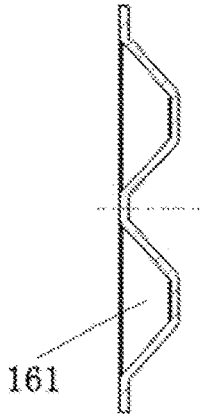
FIG. 4*b* is a schematically sectional view taken along line A-A in FIG. 4*a*, and, FIG. 4*c* is a schematically sectional view taken along line B-B in FIG. 4*a;*
Figure 4C:
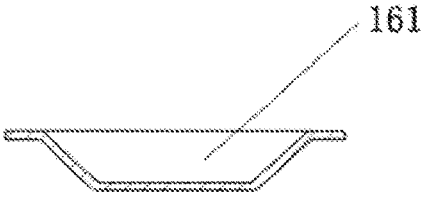
Figure 5:
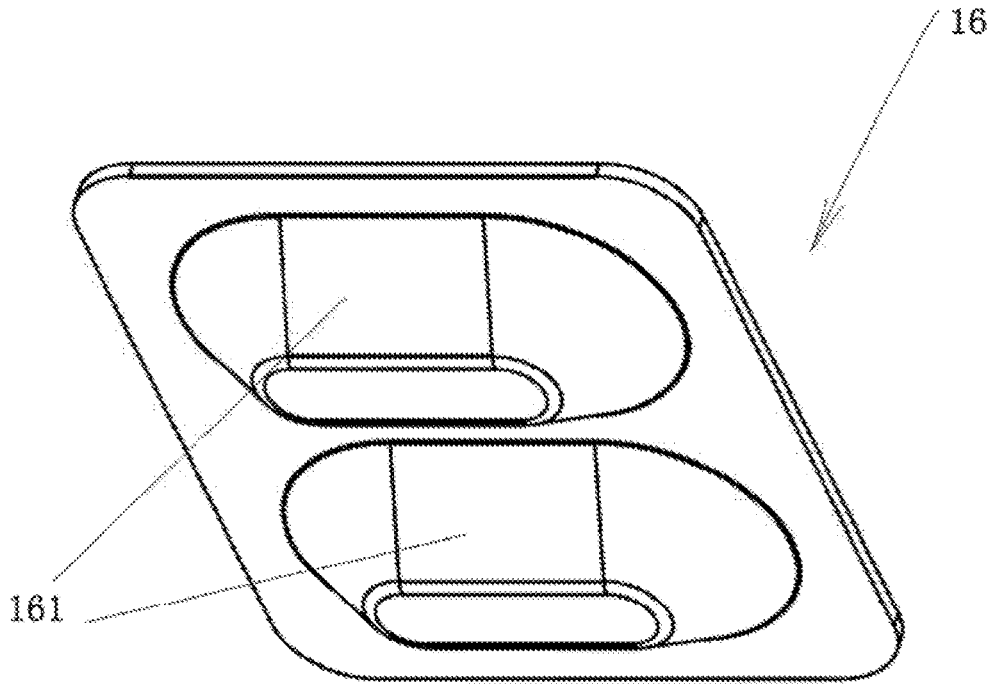
FIG. 5 is a schematically perspective view of the chamber plate of the plate heat exchanger according to the first embodiment of the present invention.
Figure 6A:
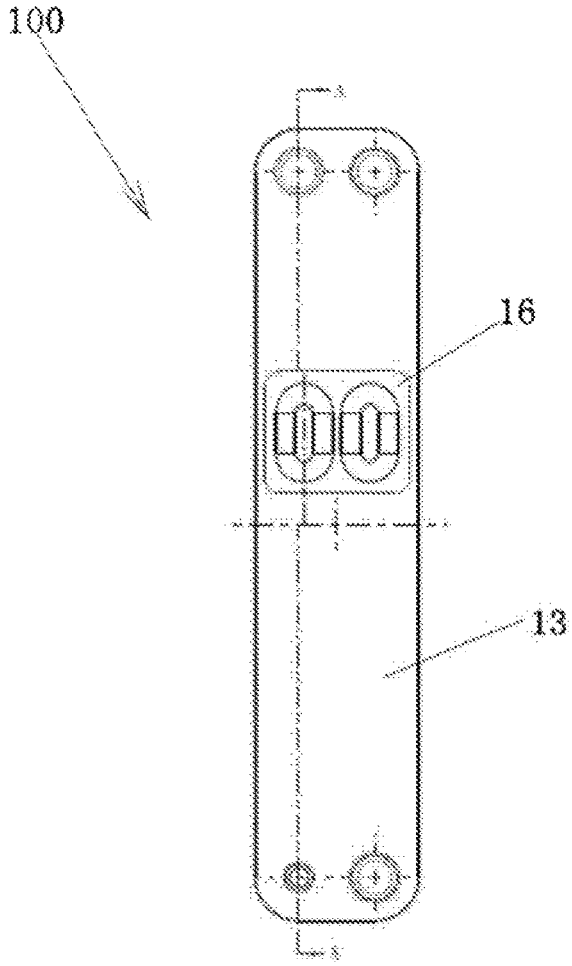
FIG. 6*a* is a schematically front view of the plate heat exchanger according to the first embodiment of the present invention.
Figure 6B:
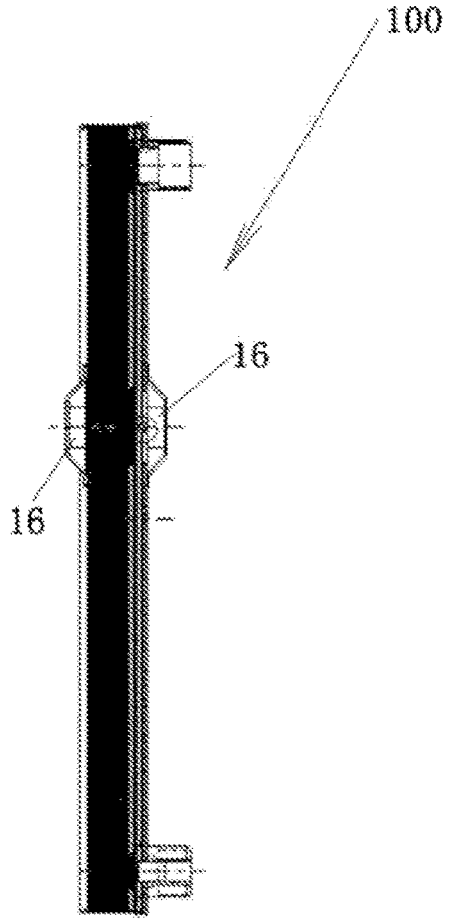
FIG. 6*b* is a schematically sectional view taken along line A-A in FIG. 6*a;*

As shown in FIGS. 2 and 3, each of the ends plates 11 and 13 has the same through holes as the corresponding side surface of the heat exchange plate 10. The heat exchange plate 10 may be integral. The plate heat exchanger 100 further comprises a first fluid inlet 1, a first fluid outlet 7, a second fluid outlet 2 (for a reverse-flow evaporator) and a second fluid inlet 6 (for a reverse-flow evaporator). First fluid, such as refrigerant, flows in one first fluid channel 12, and, second fluid, such as water, flows in one second fluid channel. Aperture size of the first fluid inlet 1 may be less than that of the first fluid outlet 7.

These heat exchange plates 10 are laminated one by one to form alternately the first fluid channels 12 and the second fluid channels in the lamination direction. For example, the heat exchange plates 10 shown in FIG. 1 are laminated alternately with heat exchange plates 10 that are in a mirror symmetry relationship to the one shown in FIG. 1, or, with heat exchange plates 10 of another kind. That is, the first fluid channel, which is formed by mating of the heat exchange plate 10 shown in FIG. 1 to a heat exchange plate 10 of another kind, is separated into two regions, while, the second fluid channel is in a direct communication manner and owns seal effect at portions of the second fluid channel corresponding to outlet 3 of an upstream portion 12U and inlet 5 of a downstream portion 12D such that the second fluid is not in direct contact with the first fluid. Apparently, those skilled in the art may achieve the second fluid channel by various means, while the first fluid channel 12 may be formed by the heat exchange plates 10 shown in FIG. 1.

As shown in FIGS. 1 and 6*a*-8, the first fluid channel 12 has the fluid channel upstream portion 12U and the fluid channel downstream portion 12D which are separated from each other in a flow direction of the fluid by means of a divider 4. The fluid channel upstream portion 12U is fluidly communicated via a fluid communication device 15 with said fluid channel downstream portion 12D. For example, at the middle of the first fluid channel 12, in a length direction of the heat exchange plate 10 or substantially in a flow direction of the fluid (for example, the refrigerant) in the first fluid channel 12, the first fluid channel 12 is separated into the fluid channel upstream portion 12U and the fluid channel downstream portion 12D.

As shown in FIG. 1, the divider 4 may be ribbon formed of solder, line-shaped brazed or soldered joint, or, metal plate. For example, the first fluid channel 12 may be closed in a width direction thereof, by the divider 4. Once a pair of heat exchange plates 10 is assembled, the divider 4 may be presented as a line-shaped brazed or soldered joint closing the first fluid channel 12 in the width direction of the heat exchange plates 10. For example, the divider 4 may be a projection formed, by pressing, on the heat exchange plate 10, and then, the divider 4 closes the first fluid channel 12 by welding, brazing, or soldering.

As shown in FIG. 1, the plate heat exchanger 100 further comprises the outlet 3 of the fluid channel upstream portion 12U and the inlet 5 of the fluid channel downstream portion 12D. The outlet 3 of the fluid channel upstream portion 12U is fluidly communicated via the fluid communication device 15 with the inlet 5 of the fluid channel downstream portion 12D. A plurality of outlets 3 of the fluid channel upstream portions 12U constitute an upstream port chamber, and, a plurality of the inlets 5 of the fluid channel downstream portions 12D constitute a downstream port chamber. The upstream port chamber and the downstream port chamber are connected to or directly to, or are fluidly communicated with or directly with, the fluid communication device. The outlets 3 of the fluid channel upstream portion 12U and the inlets 5 of the fluid channel downstream portion 12D are adjacent to the divider 4 and are provided respectively at both sides of the divider 4. For example, in the length direction (the left-right direction in FIG. 1) of the heat exchange plate 10 or substantially in a flow direction of the fluid in the first fluid channel 12, the outlets 3 and inlets 5 are provided respectively at both sides of the divider 4. The outlets 3 of the fluid channel upstream portion 12U and the inlets 5 of the fluid channel downstream portion 12D are provided at the side of the heat exchange plate 10 and the fluid communication device 15 is provided at the side of the heat exchange plate 10 or the end plate 11 or 13. For example, one or more fluid communication devices 15 are provided, or, the fluid communication devices 15 are provided at one side or both sides. The upstream port chamber and downstream port chamber are connected to or directly to one fluid communication device 15 at one side, or connected to or directly to two fluid communication devices 15 at both sides.

As shown in FIG. 1, distance between the divider 4 and said inlet 1 of the first fluid channel may be about 50-80% of the length of said heat exchange plate 10. The fluid channel upstream portion 12U and fluid channel downstream portion 12D are configured such that flow resistance of said fluid channel upstream portion 12U is greater than that of said fluid channel downstream portion 12D, or, flow resistance per unit length of said fluid channel upstream portion 12U is greater than that of said fluid channel downstream portion 12D. For example, inner wall surface of the fluid channel upstream portion 12U may be a coarse one, while the fluid channel downstream portion 12D may have a smooth surface.

Figure 8:
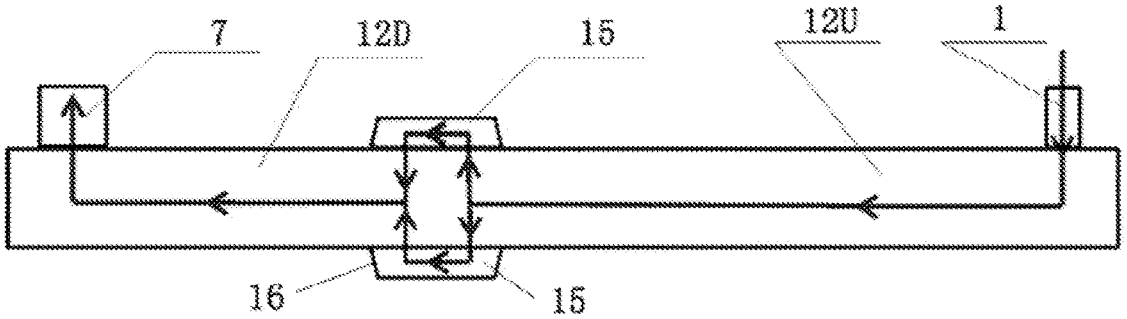
FIG. 8 is a schematic view showing a fluid flow path in one first fluid channel of the plate heat exchanger according to the first embodiment of the present invention.

As shown in FIG. 8, the fluid communication device 15 may be embodied as channel, chamber, or fluid mixing chamber.

According to one example of the present invention, as shown in FIGS. 4*a* to 7, the plate heat exchanger 100 further comprises chamber plates 16. The chamber plates 16 are disposed on the outer sides of the end plates 11 and 13 and have recesses 161 which, together with the corresponding portions of the outer sides of the end plates 11 and 13, form chambers as the fluid communication devices 15. The outlets 3 of the fluid channel upstream portion 12U and the inlets 5 of the fluid channel downstream portion 12D are fluidly communicated with the chambers. For example, the outlets 3 and the inlets 5 are fluidly communicated with the chambers, through openings, which correspond to the outlets 3 and the inlets 5, on the end plates 11 and 13. The corresponding portions are adjacent to the separation of the fluid channel upstream portion 12U and the fluid channel downstream portion 12D, or, are adjacent to the divider 4. According to one example of the present invention, in the length direction (the left-right direction in FIG. 1) of the heat exchange plate 10 or substantially in the flow direction of the fluid in the first fluid channel 12, the corresponding portions are at the location of the divider 4.

According to another example of the present invention, the end plates 11 and 13 have recesses which, together with the corresponding portions of the outer sides of the heat exchange plates 10, form chambers as the fluid communication devices 15. The outlets 3 of the fluid channel upstream portion 12U and the inlets 5 of the fluid channel downstream portion 12D are fluidly communicated with the chambers. For example, the corresponding portions are adjacent to the separation of the fluid channel upstream portion 12U and the fluid channel downstream portion 12D, or, are adjacent to the divider 4. According to one example of the present invention, in the length direction (the left-right direction in FIG. 1) of the heat exchange plate 10 or substantially in the flow direction of the fluid in the first fluid channel 12, the corresponding portions are at the location of the divider 4.

Referring to FIGS. 1, 6*a*, 6*b*, 7, and 8, according to one example of the present invention, the fluid communication devices 15 or the recesses are adjacent to the separation of the fluid channel upstream portion and the fluid channel downstream portion, or, the fluid communication devices 15 or the recesses are adjacent to the divider 4. In the length direction of the heat exchange plate 10 or substantially in the flow direction of the fluid in the first fluid channel 12, the fluid communication devices 15 or the recesses are at the location of the divider 4. In the length direction of the heat exchange plate 10 or substantially in the flow direction of the fluid in the first fluid channel 12, for example, the recesses or the fluid communication devices 15, or, the corresponding portions, go across the divider 4.

As an alternative, the outlets 3 of the fluid channel upstream portion 12U and the inlets 5 of the fluid channel downstream portion 12D may be disposed at other locations, instead of being adjacent to the divider 4.

In addition, the heat exchange plate 10 shown in FIG. 1 is an integral one and is separated by the divider 4 into two portions. As an alternative, the heat exchange plates for the first fluid channel 12 may be consisted of two separated portions.

Figure 11:
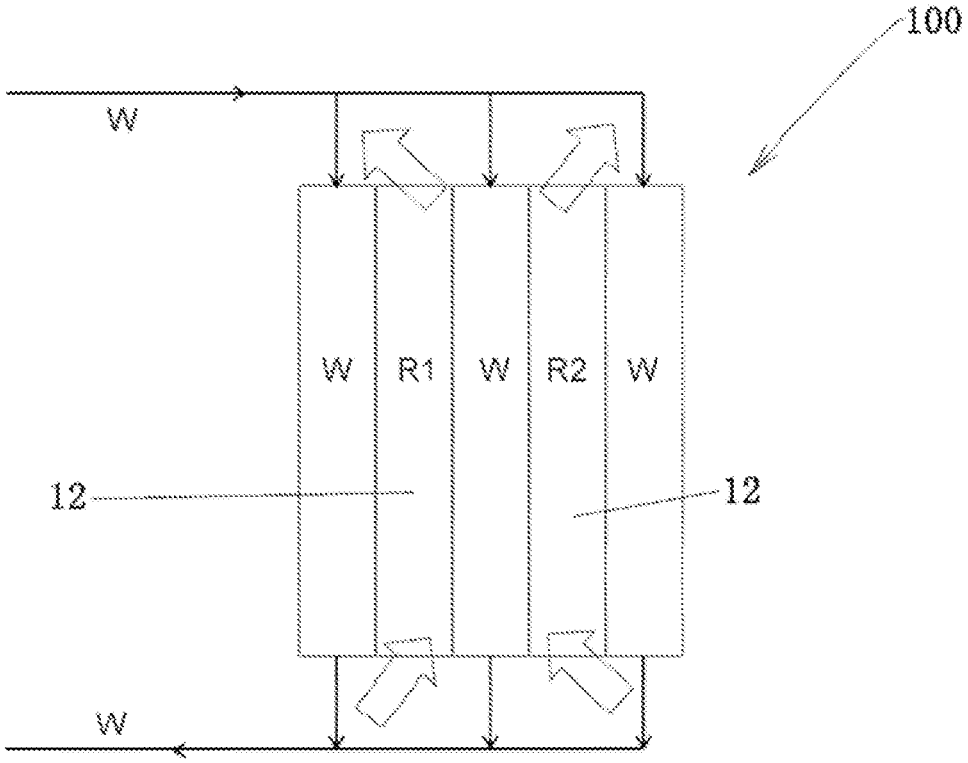
FIG. 11 is a schematic view of flowing of fluids in a dual circuit plate heat exchanger according to a third embodiment of the present invention.

As shown in FIGS. 1, 2, and 11, once a pair of heat exchange plates 10 shown in FIG. 1 are assembled, the first fluid channel 12 is separated into two heat-transfer regions (i.e., the fluid channel upstream portion 12U and the fluid channel downstream portion 12D) that are not communicated directly while the second fluid channel is a communicated groove. Moreover, the outlets 3 of the fluid channel upstream portion 12U and the inlets 5 of the fluid channel downstream portion 12D and the second fluid channel are separated such that the fluid in the first fluid channel 12 and that in the second fluid channel, for example refrigerant and water, are separated. In addition, the upstream region may adopt structure of the channel with a relative larger pressure drop, and the downstream region may adopt structure of the channel with a moderate pressure drop.

As shown in FIGS. 1-8, once a plurality of pairs of heat exchange plates 10 are assembled, the two outermost sides of the heat exchange plates 10 are mated with the end plates 11 and 13. The ends plates 11 and 13 have the corresponding through holes respectively formed at the regions corresponding to the outlets 3 of the fluid channel upstream portion 12U and the inlets 5 of the fluid channel downstream portion 12D. Based on the above configuration, the ends plates 11 and 13 are connected with the chamber plates 16. And, the chamber plates 16 are sealedly mated with the ends plates 11 and 13. In this way, a closed flow path is formed between the outlets 3 of the fluid channel upstream portion 12U and the inlets 5 of the fluid channel downstream portion 12D, excepting the inlet 1 and the outlet 7. The connection tubes are assembled to these above-mentioned components, to achieve the plate heat exchanger 100. The achieved plate heat exchanger 100 may be assembled by a copper brazing processing or a nickel brazing processing.

Figure 7:
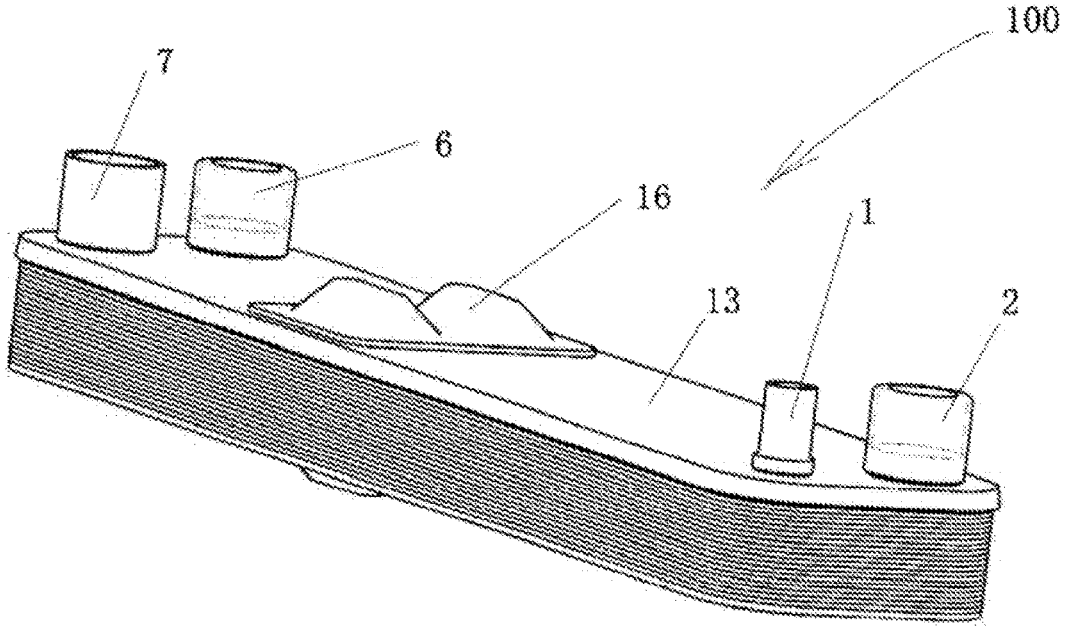
FIG. 7 is a schematic perspective view of the plate heat exchanger according to the first embodiment of the present invention.

Next, with reference to the flowing and heat-transfer process of the refrigerant, explanations of operational principle of the plate heat exchanger are provided FIG. 8 is a schematically flowing view of the refrigerant in the heat exchanger. Referring to FIGS. 1, 7, and 8, specifically, the refrigerant, after the throttle procedure by the expansion valve, enters the heat exchanger 100 in a gas-liquid two-phase manner, and is dispensed in a relative high flow rate into these paralleled first fluid channels 12, to perform the heat exchange. Then, the refrigerant leaves the fluid channel upstream portions 12U from the outlets 3 of the upstream region and enters the flow path of the upstream outlet port chamber. After that, the refrigerant is further mixed within the mixing chamber 15 on the end plate, and goes to the downstream heat exchanger region, i.e., the fluid channel downstream portion 12D, through the downstream inlet port chamber. Finally, the refrigerant completes heat exchange in the downstream heat exchanger region (i.e., the fluid channel downstream portion 12D) and leaves the heat exchanger 100.

As to distribution of the refrigerant, mal-distribution of the pressure exists in the outlet port chamber of the conventional plate heat exchanger, such that every channel has different pressure difference between the inlet and the outlet, that is, the driving forces are different, which results in mal-distribution of the refrigerant. According to the present invention, the refrigerant channel is divided into two heat exchange regions. During the flow from upstream to downstream, the pressure difference among different channels is uniformed by mean of bidirectional flow in the upstream port chamber. And, further mixing of the refrigerant in the mixing chamber on the end plate and distribution of the refrigerant within the downstream port chamber in an impinging stream manner ensure uniform distribution of the refrigerant in every channel. In this way, on the one hand, the different pressure drops are meliorated and, difficulty of the distribution is reduced by performing distribution of the refrigerant within two regions separated from one refrigerant channel; on the other hand, provision of the mixing chamber enables that the refrigerant is remixed after one stage of the heat exchange process, which improves two-phase flow characteristic of the refrigerant at flow pattern and gas-fluid uniformity, to bring conditions for further high efficient heat exchange.

As to reinforcement of the heat exchange, for an evaporation process, the refrigerant enters the heat exchange channel in a relative small dryness and leaves the heat exchanger in the form of overheat steam, in which different heat exchange mechanisms are utilized in the heat exchange process. For a heat exchange process under a relative small dryness, nuclear boiling plays a leading role in the refrigerant heat exchange process. For a heat exchange process under a relative large dryness, convection boiling plays a leading role in the refrigerant heat exchange process. Nowadays, in the market, most of the conventional plate heat exchangers adopt a single channel configuration, which is not match up with heat exchange characteristic of the refrigerant. In the present invention, the refrigerant channel is divided into two independent heat exchange regions, i.e., an upstream region and a downstream region. Accordingly, the present invention brings matching solutions for both the nuclear boiling heat exchange mechanism and the convection boiling heat exchange mechanism. On the one hand, in the upstream region, the liquid refrigerant is broken up by a channel configuration with a relative great pressure drop, to reduce thickness of the fluid film and strengthen heat exchange of the nuclear boiling. On the other hand, in the downstream region, utilization of a channel configuration with a moderated pressure drop is match up with the convection boiling and reduces flow rate of the gas, to avoid excessive speed of the gas flow which leads to entraining of liquid droplet by the gas flow, so as to affect stability of the system and whole heat exchange effect. In all, the plate heat exchanger according to the present invention may achieve a high-effective heat exchange effect.

$2^{nd}$ Embodiment

Figure 9:
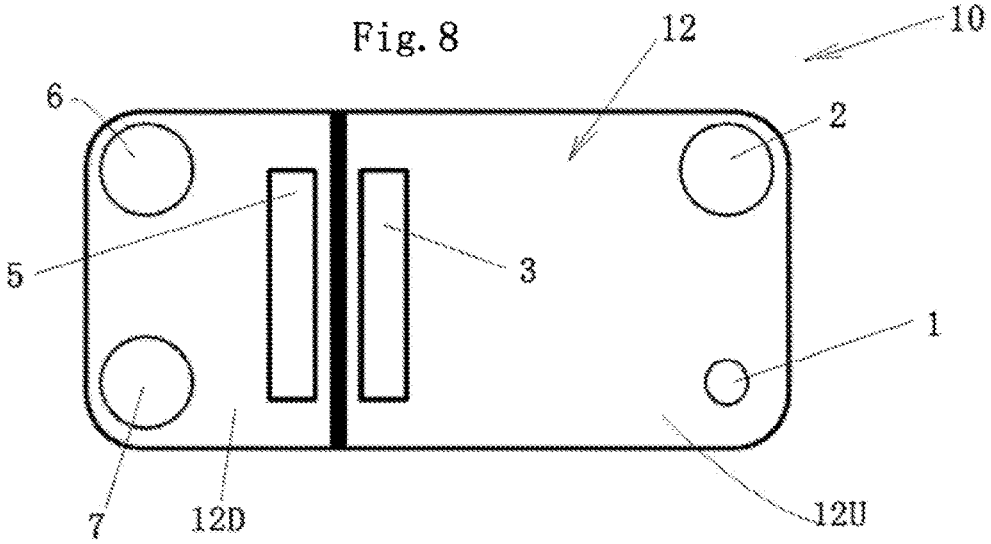
FIG. 9 is a schematic view of a heat exchange plate of a plate heat exchanger according to a second embodiment of the present invention.
Figure 10:
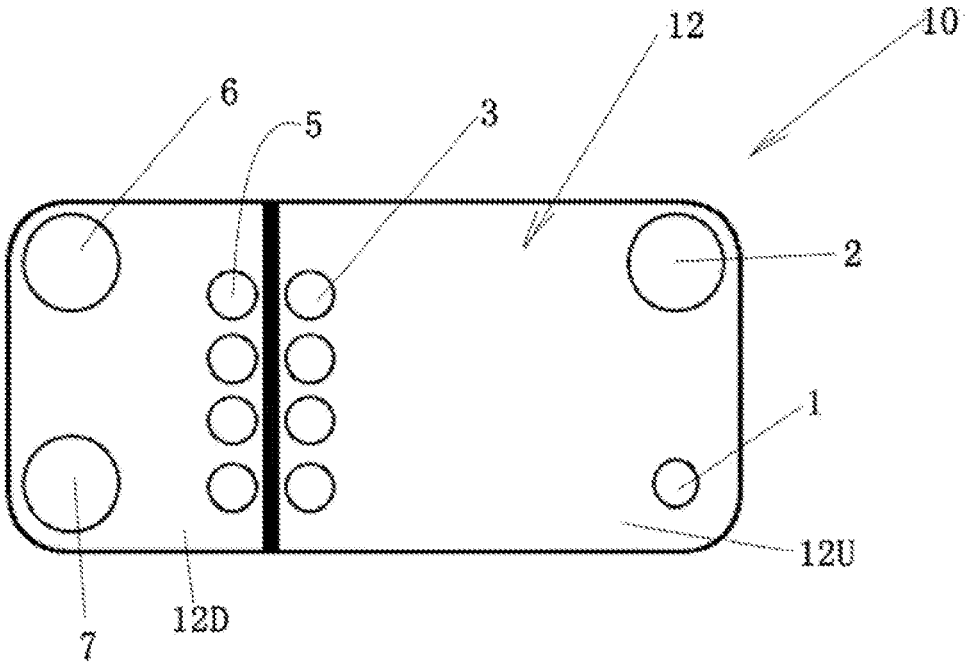
FIG. 10 is a schematic view of another heat exchange plate of the plate heat exchanger according to the second embodiment of the present invention.

As shown in FIGS. 9 and 10, for a wide plate heat exchanger 100 of relative small length breadth ratio, a rectangular flow opening or a plurality of flow openings may be adopted, to achieve communication between the upstream region and the downstream region and mixture, as shown in FIGS. 9 and 10. That is, the outlet 3 of the first fluid channel upstream portion 12U and the inlet 5 of the first fluid channel downstream portion 12D both have a generally rectangular shape, or, the plate heat exchanger 100 have a plurality of outlets 3 of the first fluid channel upstream portion 12U and a plurality of inlets 5 of the first fluid channel downstream portion 12D.

$3^{rd}$ Embodiment

Figure 12:
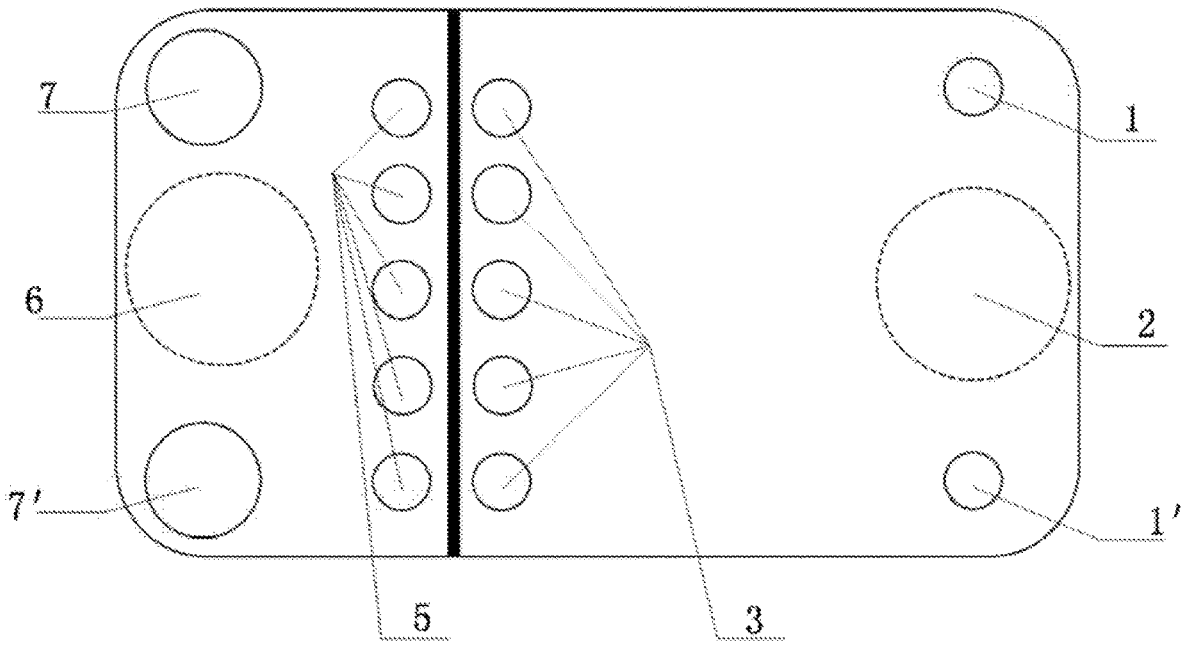
FIG. 12 is a schematic view of a heat exchange plate of the dual circuit plate heat exchanger according to the third embodiment of the present invention.

The present invention is also suitable for a dual circuit evaporator. FIG. 11 shows a schematic view of a dual circuit refrigerant plate heat exchanger 100. The plate heat exchanger 100 has two refrigerant circulating circuits which are heated commonly by one water circulating system. In FIG. 11, W indicates a water circuit, R1 indicates a first refrigerant circuit, and, R2 indicates a second refrigerant circuit. The present invention provides a solution for such application as shown in FIG. 12. For a single side-flow channel, number 1 denotes an inlet for a first refrigerant (first fluid inlet), numbers 3 and 5 denote upstream and downstream communication ports (an outlet of the first fluid channel upstream portion 12U and an inlet of the first fluid channel downstream portion 12D), number 7 denotes an outlet for the first refrigerant (first fluid outlet); number 1' denotes an inlet for a second refrigerant (first fluid inlet), number 7' denotes an outlet for the second refrigerant (first fluid outlet), number 6 denotes a water side inlet (second fluid inlet), and, number 2 denotes a water side outlet (second fluid outlet).

For a diagonal-flow channel, number 1 denotes an inlet for a first refrigerant (first fluid inlet), numbers 3 and 5 denote upstream and downstream communication ports (an outlet of the first fluid channel upstream portion 12U and an inlet of the first fluid channel downstream portion 12D), number 7' denotes an outlet for the first refrigerant (first fluid outlet); number 1' denotes an inlet for a second refrigerant (first fluid inlet), number 7 denotes an outlet for the second refrigerant (first fluid outlet), number 6 denotes a water side inlet (second fluid inlet), and, number 2 denotes a water side outlet (second fluid outlet).

Due to restrictions of water side pressure drop, the heat exchange plate at the upstream region of the refrigerant channel should adopt asymmetric configuration as far as possible, that is, the refrigerant side has a relative greater pressure drop while the water side has a relative less pressure drop.

In the above embodiments, it is described that the outlet 3 of the first fluid channel upstream portion 12U and the inlet 5 of the first fluid channel downstream portion 12D are fluidly communicated with the fluid communication device 15 or the mixing chamber. As to a plurality of first fluid channels 12, a plurality of outlets 3 of the first fluid channel upstream portions 12U and a plurality of inlets 5 of the first fluid channel downstream portions 12D, all the plurality of first fluid channel upstream portions 12U are communicated with all the plurality of outlets 3, or, some of the plurality of first fluid channel upstream portions 12U are communicated with some of the plurality of outlets 3 while the rest of the plurality of first fluid channel upstream portions 12U are communicated with the rest of the plurality of outlets 3; and, all the plurality of the first fluid channel downstream portions 12D are communicated with all the plurality of inlets 5, or, some of the plurality of first fluid channel downstream portions 12D are communicated with some of the plurality of inlets 5 while the rest of the plurality of first fluid channel downstream portions 12D are communicated with the rest of the plurality of inlets 5. As to the fluid communication device 15, the outlets 3 and the inlets 5 may be communicated with each other, respectively. All the plurality of outlets 3 are communicated with all the plurality of inlets 5, or, some of the plurality of outlets 3 are communicated with some of the plurality of inlets 5, respectively or some of the plurality of outlets 3 are communicated with some of the plurality of inlets 5, while the rest of the plurality of outlets 3 are communicated with the rest of the plurality of inlets 5, respectively, or the rest of the plurality of outlets 3 are communicated with the rest of the plurality of inlets 5. Obviously, the outlets 3 of the first fluid channel upstream portions 12U and the inlets 5 of the first fluid channel downstream portions 12D and the fluid communication device 15 may be communicated in any suitable manner. As to a multiple circuit system, the outlets 3 of the first fluid channel upstream portions 12U and the inlets 5 of the first fluid channel downstream portions 12D and the fluid communication device 15 in each circuit are not communicated with those in another circuit.

Although several exemplary embodiments have been shown and described, the present invention is not limited to these embodiments. For example, part(s) of the technical features in those exemplary embodiments may be combined with each other to form new exemplary embodiment(s). Moreover, the heat exchange plate may adopt other suitable configuration in which the first fluid channel 12 is separated into the fluid channel upstream portion and the fluid channel downstream portion. In addition, although the fluid communication device 15 is provided on the outer side of the heat exchange plate 10 or the end plates 11 and 13 as shown in the drawings, the fluid communication device 15 may also be provided within the heat exchanger, for example, the fluid communication device 15 is provided within a channel.

Moreover, once the fluid communication device 15 uses fluid passageway or pipeline, the outlet 3 of the first fluid channel upstream portion 12U and the inlet 5 of the first fluid channel downstream portion 12D may be disposed away from the divider 4.

In addition, the above-mentioned chamber or the fluid mixing chamber may be any sealed chamber that is only fluidly communicated with the outlet 3 of the first fluid channel upstream portion 12U and the inlet 5 of the first fluid channel downstream portion 12D.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A plate heat exchanger comprising:

a pair of end plates;

heat exchange plates disposed between inner sides of the end plates, each of the heat exchange plates forming one or more first fluid channels and one or more second fluid channels; and a first fluid communication device disposed on one of the end plates and a second fluid communication device disposed on the other one of the end plates;

wherein said one or more first fluid channels each has a fluid channel upstream portion and a fluid channel downstream portion separated from said fluid channel upstream portion, wherein said fluid channel upstream portion is fluidly connected via the first fluid communication device and the second fluid communication device with said fluid channel downstream portion;

wherein said one or more first fluid channels and said one or more second fluid channels are alternately disposed in a laminated direction of the heat exchange plates; and wherein the one or more first fluid channels and the one or more second fluid channels are alternately disposed in a laminated direction of the heat exchange plates in the areas of both the fluid channel upstream portion and the fluid channel downstream portion.

2. The plate heat exchanger according to claim 1, further comprising an outlet of the fluid channel upstream portion and an inlet of the fluid channel downstream portion, said outlet of the fluid channel upstream portion being fluidly connected via the first fluid communication device with said inlet of the fluid channel downstream portion.

3. The plate heat exchanger according to claim 1, further comprising a divider which separates the fluid channel upstream portion from the fluid channel downstream portion.

4. The plate heat exchanger according to claim 3, further comprising an outlet of the fluid channel upstream portion and an inlet of the fluid channel downstream portion, said outlet of the fluid channel upstream portion and said inlet of the fluid channel downstream portion being adjacent to the divider.

5. The plate heat exchanger according to claim 1, wherein said first fluid communication device comprises a channel or a chamber.

6. The plate heat exchanger according to claim 2, wherein one of the end plate has a recess which, together with a corresponding portion of one of the heat exchange plates, forms a chamber of said first fluid communication device; said outlet of the fluid channel upstream portion and said inlet of the fluid channel downstream portion being fluidly connected with said chamber.

7. The plate heat exchanger according to claim 2, further comprising a chamber plate disposed on an outer side of one of the end plates and having a recess which, together with a corresponding portion of the outer side of the end plate, forms a chamber of said first fluid communication device; said outlet of the fluid channel upstream portion and said inlet of the fluid channel downstream portion being fluidly connected with said chamber.

8. The plate heat exchanger according to claim 6, wherein said recess is at a location of a separation between the fluid channel upstream portion and the fluid channel downstream portion in a length direction of the heat exchange plates.

9. The plate heat exchanger according to claim 1, wherein each of the heat exchange plates is an integral heat exchange plate.

10. The plate heat exchanger according to claim 3, wherein a distance between said divider and an inlet of said first fluid channels is about 50-80% of the length of said heat exchange plates.

11. The plate heat exchanger according to claim 3, wherein said divider is at least one of a line-shaped brazed joint, soldered joint or metal plate.

12. The plate heat exchanger according to claim 1, wherein said first fluid communication device comprises a fluid mixing chamber.

13. The plate heat exchanger according to claim 1, wherein flow resistance of said fluid channel upstream portion is greater than that of said fluid channel downstream portion, or flow resistance per unit length of said fluid channel upstream portion is greater than that of said fluid channel downstream portion.

14. The plate heat exchanger according to claim 2, wherein said outlet of the fluid channel upstream portion constitutes an upstream port chamber, said inlet of the fluid channel downstream portion constitutes a downstream port chamber, and said upstream port chamber and said downstream port chamber are directly connected with the first fluid communication device.

15. The plate heat exchanger according to claim 2, wherein said first fluid communication device comprises a channel or a chamber.

16. The plate heat exchanger according to claim 3, wherein said first fluid communication device comprises a channel or a chamber.

17. The plate heat exchanger according to claim 4, wherein said first fluid communication device comprises a channel or a chamber.

18. The plate heat exchanger according to claim 7, wherein said recess is adjacent to a separation between the fluid channel upstream portion and the fluid channel downstream portion.

19. The plate heat exchanger according to claim 2, wherein said first fluid communication device comprises a fluid mixing chamber.

* * * * *